US012649961B2

(12) United States Patent
Magnusen et al.

(10) Patent No.: US 12,649,961 B2
(45) Date of Patent: Jun. 9, 2026

(54) 2XXX ALUMINUM ALLOYS

(71) Applicant: ARCONIC TECHNOLOGIES LLC, Pittsburgh, PA (US)

(72) Inventors: Paul E. Magnusen, Pittsburgh, PA (US); Lynette M. Karabin, Ruffs Dale, PA (US); Francine S. Bovard, Monroeville, PA (US); Julien Boselli, Pittsburgh, PA (US)

(73) Assignee: Arconic Technologies LLC, Pittsburgh, PA (US)

( * ) Notice: Subject to any disclaimer, the term of this patent is extended or adjusted under 35 U.S.C. 154(b) by 822 days.

(21) Appl. No.: 17/314,924

(22) Filed: May 7, 2021

(65) Prior Publication Data

US 2021/0262065 A1 Aug. 26, 2021

Related U.S. Application Data

(63) Continuation of application No. PCT/US2019/061769, filed on Nov. 15, 2019.

(60) Provisional application No. 62/808,181, filed on Feb. 20, 2019, provisional application No. 62/768,626, filed on Nov. 16, 2018.

(51) Int. Cl.

| | |
|---|---|
| ***C22C 21/18*** | (2006.01) |
| ***C22C 21/14*** | (2006.01) |
| ***C22C 21/16*** | (2006.01) |

(52) U.S. Cl.

CPC ..... *C22C 21/18* (2013.01); *C22C 21/14* (2013.01); *C22C 21/16* (2013.01)

(58) Field of Classification Search

None

See application file for complete search history.

(56) References Cited

U.S. PATENT DOCUMENTS

| | | | | |
|---|---|---|---|---|
| 4,772,342 | A | 9/1988 | Polmear | |
| 5,593,516 | A | 1/1997 | Cassada, III | |
| 5,630,889 | A | 5/1997 | Karabin | |
| 5,652,063 | A * | 7/1997 | Karabin | C22C 21/16 420/533 |
| 7,214,279 | B2 | 5/2007 | Fischer et al. | |
| 7,229,508 | B2 | 6/2007 | Cho et al. | |
| 7,449,073 | B2 | 11/2008 | Lin et al. | |
| 7,494,552 | B2 | 2/2009 | Benedictus et al. | |

(Continued)

FOREIGN PATENT DOCUMENTS

| | | | |
|---|---|---|---|
| CN | 1675391 | A | 9/2005 |
| CN | 1977063 | A | 6/2007 |

(Continued)

OTHER PUBLICATIONS

Davis, J.R. "Aluminum and Aluminum Alloys", ASM International, p. 63-64. (Year: 1993).*

(Continued)

*Primary Examiner* — Keith D. Hendricks
*Assistant Examiner* — Janell C Morillo
(74) *Attorney, Agent, or Firm* — Greenberg Traurig, LLP

(57) ABSTRACT

New 2xxx aluminum alloys are disclosed. The new 2xxx aluminum alloys generally include from 0.08 to 0.20 wt. % Ti. The new 2xxx aluminum alloys may realize an improved combination of two or more of strength, fracture toughness, elongation, and corrosion resistance, for instance.

19 Claims, 4 Drawing Sheets

(56) References Cited

U.S. PATENT DOCUMENTS

| | | | | |
|---|---|---|---|---|
| 7,547,366 | B2 | 6/2009 | Lin et al. | |
| 7,604,704 | B2 | 10/2009 | Benedictus et al. | |
| 8,043,445 | B2 | 10/2011 | Benedictus et al. | |
| 8,287,668 | B2 | 10/2012 | Lin et al. | |
| 8,758,530 | B2 | 6/2014 | Rioja et al. | |
| 8,764,920 | B2 | 7/2014 | Lin et al. | |
| 10,266,933 | B2 | 4/2019 | Nasserrafi et al. | |
| 10,570,485 | B2 | 2/2020 | Lin et al. | |
| 10,913,107 | B2 | 2/2021 | Felberbaum et al. | |
| 2004/0060618 | A1 | 4/2004 | Benedictus et al. | |
| 2004/0112480 | A1 | 6/2004 | Benedictus et al. | |
| 2005/0081965 | A1 | 4/2005 | Benedictus et al. | |
| 2005/0084408 | A1† | 4/2005 | Cho | |
| 2006/0011272 | A1 | 1/2006 | Lin et al. | |
| 2007/0131313 | A1† | 6/2007 | Cho | |
| 2007/0243097 | A1 | 10/2007 | Sarrazin et al. | |
| 2008/0029187 | A1 | 2/2008 | Lin et al. | |
| 2008/0060724 | A2 | 3/2008 | Benedictus et al. | |
| 2010/0183474 | A1 | 7/2010 | Lin et al. | |
| 2011/0056597 | A1 | 3/2011 | Rioja et al. | |
| 2012/0138195 | A1* | 6/2012 | Philbrook | C22F 1/057 148/552 |
| 2012/0261039 | A1 | 10/2012 | Cho | |
| 2013/0068411 | A1* | 3/2013 | Forde | C22C 21/14 420/533 |
| 2013/0302206 | A1 | 11/2013 | Boselli et al. | |
| 2014/0137995 | A1 | 5/2014 | Lin et al. | |
| 2014/0248176 | A1 | 9/2014 | Lin et al. | |
| 2015/0284826 | A1 | 10/2015 | Cho | |
| 2016/0047022 | A1 | 2/2016 | Nasserrafi | |
| 2016/0115576 | A1 | 4/2016 | Long et al. | |
| 2018/0117650 | A1 | 5/2018 | Felberbaum et al. | |
| 2018/0117669 | A1 | 5/2018 | Felberbaum et al. | |
| 2019/0193185 | A1 | 6/2019 | Li et al. | |
| 2021/0046540 | A1 | 2/2021 | Felberbaum et al. | |
| 2021/0388470 | A1 | 12/2021 | Chevy et al. | |

FOREIGN PATENT DOCUMENTS

| | | | | |
|---|---|---|---|---|
| CN | 101124346 | A | 2/2008 | |
| CN | 101410540 | A | 4/2009 | |
| CN | 101580910 | A | 11/2009 | |
| CN | 102292463 | A | 12/2011 | |
| CN | 102625858 | A | 8/2012 | |
| EP | 2719784 | A1 | 4/2014 | |
| EP | 3009525 | A1 | 4/2016 | |
| WO | 2004018721 | A1 | 3/2004 | |
| WO | WO-2009036953 | A1 * | 3/2009 | C22C 21/18 |
| WO | 2018080706 | A1 | 5/2018 | |
| WO | 2019125594 | A1 | 6/2019 | |
| WO | 2020074818 | A1 | 4/2020 | |

OTHER PUBLICATIONS

Registration Record Series Teal Sheets, "International Alloy Designations and Chemical Composition Limits for Wrought Aluminum and Wrought Aluminum Alloys," The Aluminum Association, 45 pages (2015).

American National Standard Alloy and Temper Designation Systems for Aluminum, ANSI H35.1, 6 pages (2009).

International Search Report to corresponding International Application No. PCT/US2019/061769 mailed Jul. 6, 2020, 4 pages (2020).

Written Opinion to corresponding International Application No. PCT/US2019/061769 mailed Jul. 6, 2020, 7 pages (2020).

Supplementary EP Search Report to corresponding EP Application No. 19 89 4434 mailed Jul. 5, 2022, 11 pages.

Cho, Alex et al., "Damage Tolerance Capability of an Al—Cu—Mg—Ag Alloy (2139," Materials Science Forum, vol. 519-521, pp. 603-608 (2006).

Declaration under 37 CFR 1.132 of Michael J. Philbrook submitted in U.S. Appl. No. 11/625,113, signed Jul. 1, 2009, 4 pages.†

Registration Record Series Teal Sheets, International Alloy Designations and Chemical Composition Limits for Wrought Aluminum and Wrought Aluminum Alloys, 2018, 45 pages.†

* cited by examiner
† cited by third party

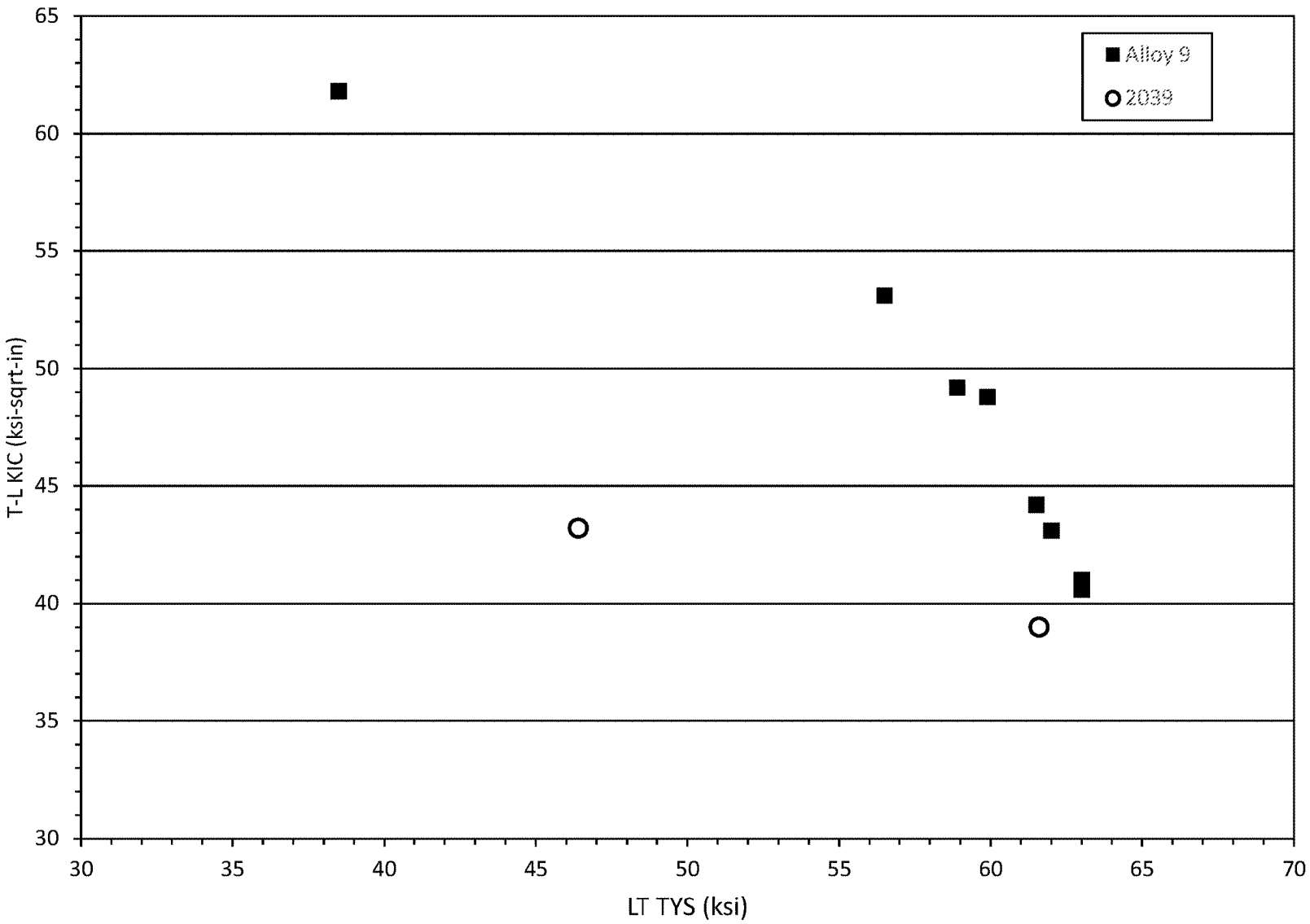
FIG. 1 - Properties of Example 2 Alloys (2% stretch)

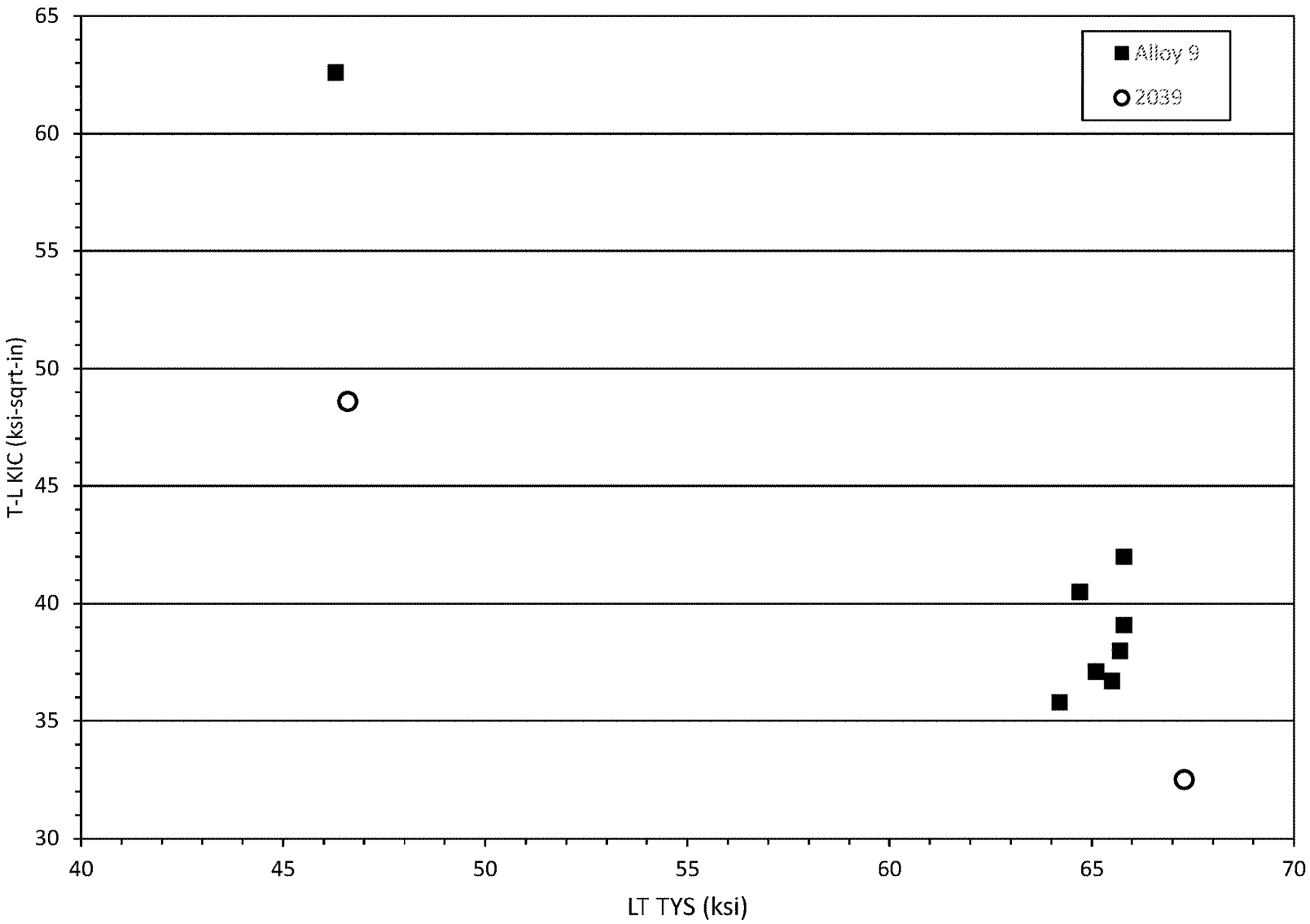
FIG. 2 - Properties of Example 2 Alloys (8% stretch)

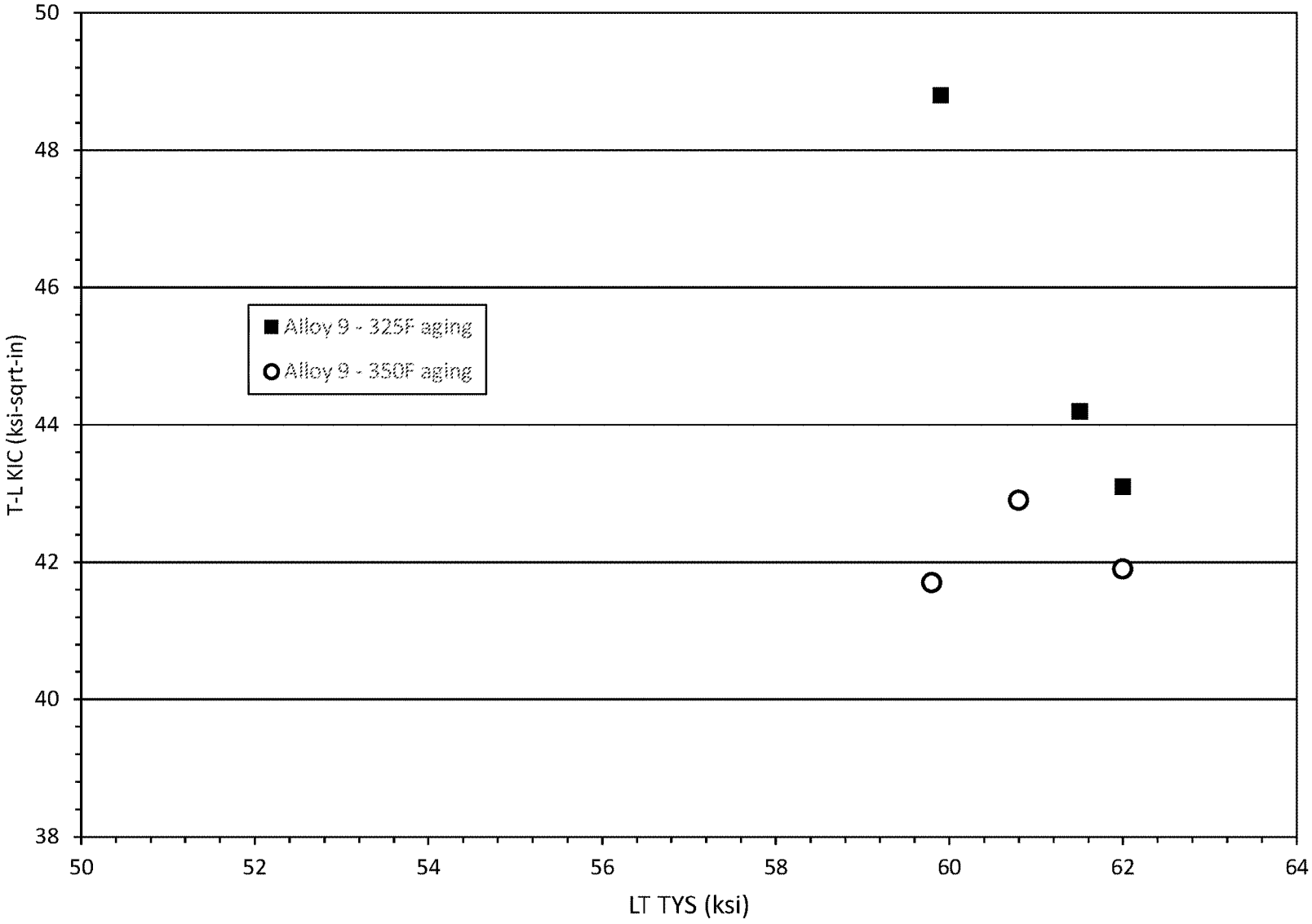
FIG. 3 - Properties of Alloy 9 at 325F and 350F aging with 2% stretch

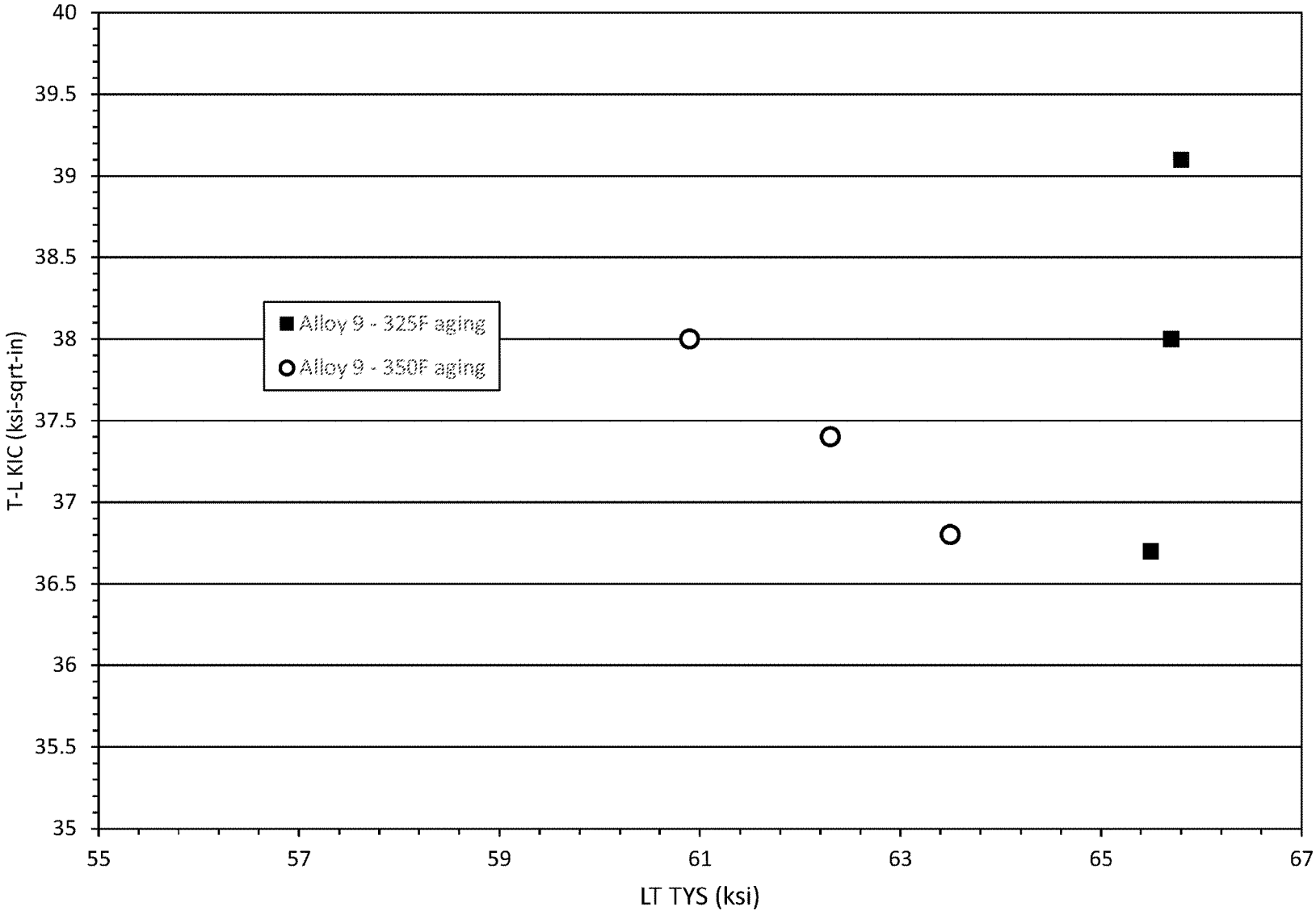
FIG. 4 - Properties of Alloy 9 at 325F and 350F aging with 8% stretch

2XXX ALUMINUM ALLOYS

CROSS-REFERENCE TO RELATED APPLICATION

This application is a continuation of International Patent No. PCT/US2019/061769, filed Nov. 15, 2019, which claims benefit of priority of U.S. Patent Application No. 62/768,626, filed Nov. 16, 2018 and claims benefit of priority of U.S. Patent Application No. 62/808,181, filed Feb. 20, 2019, entitled "2XXX Aluminum Alloys", each of which is incorporated herein by reference in its entirety.

FIELD OF THE INVENTION

The present disclosure relates to 2*xxx* aluminum alloys and products made therefrom.

BACKGROUND

Aluminum alloys are useful in a variety of applications. However, improving one property of an aluminum alloy without degrading another property often proves elusive. For example, it is difficult to increase the strength of an alloy without decreasing the toughness of an alloy. Other properties of interest for aluminum alloys include corrosion resistance and fatigue crack growth rate resistance, to name two.

SUMMARY OF THE INVENTION

Broadly, the present patent application relates to new 2xxx aluminum alloys. Generally, the new 2xxx aluminum alloys include from 0.08 to 0.20 wt. % Ti, which may facilitate, for instance, an improved combination of at least two or more of strength, ductility, fracture toughness and stress corrosion cracking resistance properties. The new 2xxx aluminum alloys may also include zirconium in combination with the titanium, which also may facilitate realization of an improved combination of at least two or more of strength, ductility, fracture toughness and stress corrosion cracking resistance properties. The new 2xxx aluminum alloys may also include zinc (e.g. from 0.10-1.0 wt. % Zn) with the titanium and/or zirconium, which may also facilitate realization of an improved combination of at least two or more of strength, ductility, fracture toughness and stress corrosion cracking resistance properties.

In one approach, a new 2xxx aluminum alloy comprises (and in some instances consists essentially of, or consists of) from 0.08 to 0.20 wt. % Ti, from 4.5 to 5.5 wt. % Cu, from 0.20 to 0.6 wt. % Mn, from 0.20 to 0.8 wt. % Mg, from 0.05 to 0.60 wt. % Ag, up to 1.0 wt. % Zn, up to 0.30 wt. % Fe, up to 0.20 wt. % Si, up to 0.25 wt. % Zr, up to 0.25 wt. % Cr, and up to 0.25 wt. % V, the balance being aluminum, incidental elements and impurities. In one embodiment, the new 2xxx aluminum alloy is a 2039 alloy (as defined by the Aluminum Association Teal Sheets document, described below) modified to include 0.08 to 0.20 wt. % Ti, such as any of the titanium limits/ranges described below. In one embodiment, the new 2xxx aluminum alloy is a 2039 alloy modified to include 0.08 to 0.20 wt. % Ti and from 0 to 0.10 wt. % Zr. The teachings of this paragraph also apply to other 2×39 alloys, such as 2139. The new 2xxx aluminum alloys described herein may realize an improved combination of at least two of strength, fracture toughness, elongation, and stress corrosion cracking resistance, among others.

i. Composition

As noted above, the new 2xxx aluminum alloys generally include 0.08 to 0.20 wt. % Ti. The use of titanium in combination with other elements of the new 2xxx aluminum alloys may result in new 2xxx aluminum alloys products having an improved combination of properties, such as an improved combination of two or more of strength, ductility (elongation), fracture toughness and stress corrosion cracking resistance, among others. The amount of titanium present in the new 2xxx aluminum alloys should be limited such that large primary particles do not form in the alloy. In one embodiment, a new 2xxx aluminum alloy includes at least 0.09 wt. % Ti. In another embodiment, a new 2xxx aluminum alloy includes at least 0.10 wt. % Ti. In yet another embodiment, a new 2xxx aluminum alloy includes at least 0.11 wt. % Ti. In one embodiment, a new 2xxx aluminum alloy includes not greater than 0.18 wt. % Ti. In another embodiment, a new 2xxx aluminum alloy includes not greater than 0.16 wt. % Ti. In yet another embodiment, a new 2xxx aluminum alloy includes not greater than 0.15 wt. % Ti. In another embodiment, a new 2xxx aluminum alloy includes not greater than 0.14 wt. % Ti. In yet another embodiment, a new 2xxx aluminum alloy includes not greater than 0.13 wt. % Ti. The titanium may facilitate improved stress corrosion cracking resistance properties while also facilitating, for instance, grain refining, among other things. Titanium may be added as a separate element and/or as part of a grain refining compound. Examples of grain refiners include Ti combined with B (e.g., TiB2) or carbon (TiC), although other grain refiners, such as Al—Ti master alloys may be utilized. Grain refiners in combination with elemental titanium may be used in the new 2xxx aluminum alloys in any appropriate amount, and generally depending on the desired as-cast grain size.

As noted above, a new 2xxx aluminum alloy may include from 4.5 to 5.5 wt. % Cu. In one embodiment, a new 2xxx aluminum alloy includes at least 4.6 wt. % Cu. In another embodiment, a new 2xxx aluminum alloy includes at least 4.7 wt. % Cu. In yet another embodiment, a new 2xxx aluminum alloy includes at least 4.8 wt. % Cu. In one embodiment, a new 2xxx aluminum alloy includes not greater than 5.4 wt. % Cu. In another embodiment, a new 2xxx aluminum alloy includes not greater than 5.3 wt. % Cu. In yet another embodiment, a new 2xxx aluminum alloy includes not greater than 5.2 wt. % Cu. In another embodiment, a new 2xxx aluminum alloy includes not greater than 5.1 wt. % Cu. In yet another embodiment, a new 2xxx aluminum alloy includes not greater than 5.0 wt. % Cu.

As noted above, a new 2xxx aluminum alloy may include from 0.20 to 0.6 wt. % Mn. In one embodiment, a new 2xxx aluminum alloy includes at least 0.25 wt. % Mn. In another embodiment, a new 2xxx aluminum alloy includes at least 0.30 wt. % Mn. In one embodiment, a new 2xxx aluminum alloy includes not greater than 0.55 wt. % Mn. In another embodiment, a new 2xxx aluminum alloy includes not greater than 0.50 wt. % Mn. In yet another embodiment, a new 2xxx aluminum alloy includes not greater than 0.45 wt. % Mn. In another embodiment, a new 2xxx aluminum alloy includes not greater than 0.40 wt. % Mn.

As noted above, a new 2xxx aluminum alloy may include from 0.20 to 0.6 wt. % Mg. In one embodiment, a new 2xxx aluminum alloy includes at least 0.25 wt. % Mg. In another embodiment, a new 2xxx aluminum alloy includes at least 0.30 wt. % Mg. In one embodiment, a new 2xxx aluminum alloy includes not greater than 0.55 wt. % Mg. In another embodiment, a new 2xxx aluminum alloy includes not greater than 0.50 wt. % Mg.

As noted above, a new 2xxx aluminum alloy may include from 0.05 to 0.6 wt. % Ag. In one embodiment, a new 2xxx aluminum alloy includes at least 0.10 wt. % Ag. In another embodiment, a new 2xxx aluminum alloy includes at least 0.15 wt. % Ag. In yet another embodiment, a new 2xxx aluminum alloy includes at least 0.20 wt. % Ag. In another embodiment, a new 2xxx aluminum alloy includes at least 0.25 wt. % Ag. In yet another embodiment, a new 2xxx aluminum alloy includes at least 0.30 wt. % Ag. In one embodiment, a new 2xxx aluminum alloy includes not greater than 0.55 wt. % Ag. In another embodiment, a new 2xxx aluminum alloy includes not greater than 0.50 wt. % Ag. In yet another embodiment, a new 2xxx aluminum alloy includes not greater than 0.45 wt. % Ag. In another embodiment, a new 2xxx aluminum alloy includes not greater than 0.40 wt. % Ag.

As noted above, a new 2xxx aluminum alloy may include up to 1.0 wt. % Zn. In one embodiment, a new 2xxx aluminum alloy includes at least 0.10 wt. % Zn. In another embodiment, a new 2xxx aluminum alloy includes at least 0.20 wt. % Zn. In yet another embodiment, a new 2xxx aluminum alloy includes at least 0.30 wt. % Zn. In another embodiment, a new 2xxx aluminum alloy includes at least 0.40 wt. % Zn. In yet another embodiment, a new 2xxx aluminum alloy includes at least 0.50 wt. % Zn. In one embodiment, a new 2xxx aluminum alloy includes not greater than 0.90 wt. % Zn. In another embodiment, a new 2xxx aluminum alloy includes not greater than 0.80 wt. % Zn. In yet another embodiment, a new 2xxx aluminum alloy includes not greater than 0.70 wt. % Zn. In another embodiment, a new 2xxx aluminum alloy includes not greater than 0.60 wt. % Zn.

As noted above, a new 2xxx aluminum alloy may include up to 0.25 wt. % Zr. In some embodiments, the combination of both (a) elevated levels of titanium, and (b) use of zirconium may facilitate the realization of improved 2xxx aluminum alloy products having an improved combination of at least two of strength, elongation, fracture toughness and stress corrosion cracking resistance, among others. In one embodiment, a new 2xxx aluminum alloy includes at least 0.05 wt. % Zr. In another embodiment, a new 2xxx aluminum alloy includes at least 0.06 wt. % Zr. In yet another embodiment, a new 2xxx aluminum alloy includes at least 0.07 wt. % Zr. In another embodiment, a new 2xxx aluminum alloy includes at least 0.08 wt. % Zr. In one embodiment, a new 2xxx aluminum alloy includes not greater than 0.18 wt. % Zr. In another embodiment, a new 2xxx aluminum alloy includes not greater than 0.16 wt. % Zr. In yet another embodiment, a new 2xxx aluminum alloy includes not greater than 0.15 wt. % Zr. In another embodiment, a new 2xxx aluminum alloy includes not greater than 0.14 wt. % Zr. In yet another embodiment, a new 2xxx aluminum alloy includes not greater than 0.13 wt. % Zr. In another embodiment, a new 2xxx aluminum alloy includes not greater than 0.12 wt. % Zr. In yet another embodiment, a new 2xxx aluminum alloy includes not greater than 0.11 wt. % Zr. In another embodiment, a new 2xxx aluminum alloy includes not greater than 0.10 wt. % Zr. In yet another embodiment, a new 2xxx aluminum alloy includes not greater than 0.09 wt. % Zr. In another embodiment, a new 2xxx aluminum alloy includes not greater than 0.08 wt. % Zr.

As noted above, a new 2xxx aluminum alloy may include up to 0.30 wt. % Fe. In one embodiment, a new 2xxx aluminum alloy includes at least 0.01 wt. % Fe. In another embodiment, a new 2xxx aluminum alloy includes at least 0.02 wt. % Fe. In one embodiment, a new 2xxx aluminum alloy includes not greater than 0.25 wt. % Fe. In another embodiment, a new 2xxx aluminum alloy includes not greater than 0.20 wt. % Fe. In yet another embodiment, a new 2xxx aluminum alloy includes not greater than 0.15 wt. % Fe. In another embodiment, a new 2xxx aluminum alloy includes not greater than 0.10 wt. % Fe. In yet another embodiment, a new 2xxx aluminum alloy includes not greater than 0.08 wt. % Fe. In another embodiment, a new 2xxx aluminum alloy includes not greater than 0.06 wt. % Fe. In yet another embodiment, a new 2xxx aluminum alloy includes not greater than 0.04 wt. % Fe.

As noted above, a new 2xxx aluminum alloy may include up to 0.20 wt. % Si. In one embodiment, a new 2xxx aluminum alloy includes at least 0.01 wt. % Si. In another embodiment, a new 2xxx aluminum alloy includes at least 0.02 wt. % Si. In one embodiment, a new 2xxx aluminum alloy includes not greater than 0.15 wt. % Si. In another embodiment, a new 2xxx aluminum alloy includes not greater than 0.10 wt. % Si. In yet another embodiment, a new 2xxx aluminum alloy includes not greater than 0.07 wt. % Si. In another embodiment, a new 2xxx aluminum alloy includes not greater than 0.05 wt. % Si. In yet another embodiment, a new 2xxx aluminum alloy includes not greater than 0.03 wt. % Si.

As noted above, a new 2xxx aluminum alloy may include up to 0.25 wt. % Cr. In one embodiment, a new 2xxx aluminum alloy includes not greater than 0.20 wt. % Cr. In another embodiment, a new 2xxx aluminum alloy includes not greater than 0.15 wt. % Cr. In another embodiment, a new 2xxx aluminum alloy includes not greater than 0.10 wt. % Cr. In yet another embodiment, a new 2xxx aluminum alloy includes not greater than 0.05 wt. % Cr. In another embodiment, a new 2xxx aluminum alloy includes not greater than 0.03 wt. % Cr. In yet another embodiment, a new 2xxx aluminum alloy includes not greater than 0.01 wt. % Cr.

As noted above, a new 2xxx aluminum alloy may include up to 0.25 wt. % V. In one embodiment, a new 2xxx aluminum alloy includes not greater than 0.20 wt. % V. In another embodiment, a new 2xxx aluminum alloy includes not greater than 0.15 wt. % V. In another embodiment, a new 2xxx aluminum alloy includes not greater than 0.10 wt. % V. In yet another embodiment, a new 2xxx aluminum alloy includes not greater than 0.05 wt. % V. In another embodiment, a new 2xxx aluminum alloy includes not greater than 0.03 wt. % V. In yet another embodiment, a new 2xxx aluminum alloy includes not greater than 0.01 wt. % V.

Some embodiments of useful alloys in accordance with the present disclosure are provided below (all values in weight percent).

| Alloy | Cu | Mn | Mg | Zn | Ag | Ti |
|---|---|---|---|---|---|---|
| A | 4.5-5.5 | 0.20-0.60 | 0.20-0.60 | 0.10-1.0 | 0.05-0.60 | 0.08-0.20 |
| B | 4.6-5.4 | 0.20-0.55 | 0.25-0.55 | 0.20-0.80 | 0.10-0.55 | 0.08-0.18 |
| C | 4.7-5.3 | 0.25-0.50 | 0.30-0.55 | 0.30-0.70 | 0.15-0.50 | 0.08-0.16 |
| D | 4.8-5.2 | 0.25-0.45 | 0.35-0.55 | 0.30-0.60 | 0.20-0.45 | 0.08-0.15 |
| E | 4.8-5.1 | 0.25-0.40 | 0.35-0.50 | 0.40-0.60 | 0.25-0.40 | 0.08-0.14 |

-continued

| F | 4.8-5.0 | 0.30-0.40 | 0.40-0.50 | 0.40-0.60 | 0.30-0.40 | 0.08-0.13 |
|---|---|---|---|---|---|---|
| Alloy (cont.) | Zr | Fe | Si | Cr | V | Balance |
| A | ≤0.25 | ≤0.30 | ≤0.25 | ≤0.25 | ≤0.25 | Aluminum, |
| B | 0.05-0.18 | 0.01-0.25 | 0.01-0.25 | ≤0.15 | ≤0.15 | incidental |
| C | 0.05-0.16 | 0.01-0.20 | 0.01-0.20 | ≤0.10 | ≤0.10 | elements |
| D | 0.06-0.14 | 0.01-0.15 | 0.01-0.15 | ≤0.05 | ≤0.05 | and |
| E | 0.07-0.13 | 0.02-0.10 | 0.02-0.10 | ≤0.03 | ≤0.03 | impurities. |
| F | 0.08-0.12 | 0.02-0.08 | 0.02-0.07 | ≤0.03 | ≤0.03 | |

As noted above, in one approach, the new 2xxx aluminum alloy is a 2039 aluminum alloy modified to include 0.08 to 0.20 wt. % Ti, such as any of the titanium limits/ranges described above. Per the Aluminum Association Teal Sheets (2015), a 2039 aluminum alloy comprises 4.5 to 5.5 wt. % Cu, 0.20 to 0.50 wt. % Mn, 0.40 to 0.8 wt. % Mg, 0.05 to 0.50 wt. % Ag, 0.10 to 0.25 wt. % Zr, up to 0.20 wt. % Si, up to 0.30 wt. % Fe, up to 0.15 wt. % Ti, the balance being aluminum, incidental elements and impurities, wherein the new 2xxx aluminum alloy includes not greater than 0.15 wt. %, in total, of the impurities, and wherein the 2xxx aluminum alloy includes not greater than 0.05 wt. % of each of the impurities.

As noted above, in one approach, the new 2xxx aluminum alloy is a 2139 aluminum alloy modified to include 0.08 to 0.20 wt. % Ti, such as any of the titanium limits/ranges described above. Per the Aluminum Association Teal Sheets (2015), a 2139 aluminum alloy comprises 4.5 to 5.5 wt. % Cu, 0.20 to 0.6 wt. % Mn, 0.20 to 0.8 wt. % Mg, 0.15 to 0.60 wt. % Ag, up to 0.10 wt. % Si, up to 0.15 wt. % Fe, up to 0.05 wt. % Cr, up to 0.25 wt. % Zn, up to 0.15 wt. % Ti, up to 0.05 wt. % V, the balance being aluminum, incidental elements and impurities, wherein the new 2xxx aluminum alloy includes not greater than 0.15 wt. %, in total, of the impurities, and wherein the 2xxx aluminum alloy includes not greater than 0.05 wt. % of each of the impurities.

In one embodiment, a new 2039 aluminum alloy or new 2139 aluminum alloy is modified to include from 0.08 to 0.20 wt. % Ti, such as any of the titanium limits/ranges described above ("a modified 2039/2139 aluminum alloy"), and is further modified to include zinc (Zn). In one embodiment, a modified 2039/2139 aluminum alloy includes from 0.08 to 0.20 wt. % Ti and includes from 0.10 to 1.0 wt. % Zn. In one embodiment, a modified 2039/2139 aluminum alloy includes at least 0.20 wt. % Zn. In another embodiment, a modified 2039/2139 aluminum alloy includes at least 0.30 wt. % Zn. In another embodiment, a modified 2039/2139 aluminum alloy includes at least 0.40 wt. % Zn. In another embodiment, a modified 2039/2139 aluminum alloy includes at least 0.50 wt. % Zn. In one embodiment, a modified 2039/2139 aluminum alloy includes not greater than 0.90 wt. % Zn. In another embodiment, a modified 2039/2139 aluminum alloy includes not greater than 0.80 wt. % Zn. In another embodiment, a modified 2039/2139 aluminum alloy includes not greater than 0.70 wt. % Zn. In another embodiment, a modified 2039/2139 aluminum alloy includes not greater than 0.60 wt. % Zn.

In one embodiment, a new 2039/2139 aluminum alloy is modified to include from 0.08 to 0.20 wt. % Ti, such as any of the titanium limits/ranges described above ("a modified 2139 aluminum alloy"), and is further modified to include appropriate amounts of zirconium. (2039, as specified by the Aluminum Association Teal Sheets, includes 0.10-0.25 wt. % Zr, and 2139, as specified by the Aluminum Association Teal Sheets, includes zirconium as an impurity only.) The combination of both (a) elevated levels of titanium, and (b) use of zirconium may facilitate the realization of improved 2039/2139 aluminum alloy products having an improved combination of at least two of strength, elongation, fracture toughness and stress corrosion cracking resistance, among others. In one embodiment, a modified 2039/2139 aluminum alloy includes from 0.05 to 0.20 wt. % Zr. In one embodiment, a modified 2039/2139 aluminum alloy includes at least 0.06 wt. % Zr. In another embodiment, a modified 2039/2139 aluminum alloy includes at least 0.07 wt. % Zr. In yet another embodiment, a modified 2039/2139 aluminum alloy includes at least 0.08 wt. % Zr. In one embodiment, a modified 2039/2139 aluminum alloy includes not greater than 0.18 wt. % Zr. In another embodiment, a modified 2039/2139 aluminum alloy includes not greater than 0.16 wt. % Zr. In another embodiment, a modified 2039/2139 aluminum alloy includes not greater than 0.15 wt. % Zr. In yet another embodiment, a modified 2039/2139 aluminum alloy includes not greater than 0.14 wt. % Zr. In another embodiment, a modified 2039/2139 aluminum alloy includes not greater than 0.13 wt. % Zr. In another embodiment, a modified 2039/2139 aluminum alloy includes not greater than 0.12 wt. % Zr. In another embodiment, a modified 2039/2139 aluminum alloy includes not greater than 0.11 wt. % Zr. In yet another embodiment, a modified 2039/2139 aluminum alloy includes not greater than 0.10 wt. % Zr. In another embodiment, a modified 2039/2139 aluminum alloy includes not greater than 0.09 wt. % Zr. In another embodiment, a modified 2039/2139 aluminum alloy includes not greater than 0.08 wt. % Zr. In one embodiment, a modified 2039/2139 aluminum alloy includes from 0.05 wt. % to 0.15 wt. % Zr. In another embodiment, a modified 2039/2139 aluminum alloy includes from 0.07 wt. % to 0.14 wt. % Zr. In another embodiment, a modified 2039/2139 aluminum alloy includes from 0.08 wt. % to 0.13 wt. % Zr. The amount of zirconium present in the new 2xxx aluminum alloys should be limited such that large primary particles do not form in the alloy.

In one embodiment, a new 2139 aluminum alloy is modified to include from 0.08 to 0.20 wt. % Ti, such as any of the titanium limits/ranges described above ("a modified 2139 aluminum alloy"), and is further modified to include zirconium, such as any of the zirconium limits/ranges described above, and is further modified to include zinc, such as any of the zinc limits/ranges described above.

As noted above, the new alloys generally include the stated alloying ingredients, the balance being aluminum, optional incidental elements, and impurities. As used herein, "incidental elements" means those elements or materials, other than the above listed elements, that may optionally be added to the alloy to assist in the production of the alloy.

Examples of incidental elements include casting aids, such as grain refiners and deoxidizers. Optional incidental elements may be included in the alloy in a cumulative amount of up to 1.0 wt. %. As one non-limiting example, one or more incidental elements may be added to the alloy during casting to reduce or restrict (and in some instances eliminate) ingot cracking due to, for example, oxide fold, pit and oxide patches. These types of incidental elements are generally referred to herein as deoxidizers. Examples of some deoxidizers include Ca, Sr, and Be. When calcium (Ca) is included in the alloy, it is generally present in an amount of up to about 0.05 wt. %, or up to about 0.03 wt. %. In some embodiments, Ca is included in the alloy in an amount of about 0.001-0.03 wt % or about 0.05 wt. %, such as 0.001-0.008 wt. % (or 10 to 80 ppm). Strontium (Sr) may be included in the alloy as a substitute for Ca (in whole or in part), and thus may be included in the alloy in the same or similar amounts as Ca. Traditionally, beryllium (Be) additions have helped to reduce the tendency of ingot cracking, though for environmental, health and safety reasons, some embodiments of the alloy are substantially Be-free. When Be is included in the alloy, it is generally present in an amount of up to about 20 ppm. Incidental elements may be present in minor amounts, or may be present in significant amounts, and may add desirable or other characteristics on their own without departing from the alloy described herein, so long as the alloy retains the desirable characteristics described herein. It is to be understood, however, that the scope of this disclosure should not/cannot be avoided through the mere addition of an element or elements in quantities that would not otherwise impact on the combinations of properties desired and attained herein.

The new 2xxx aluminum alloys generally contain low amounts of impurities. In one embodiment, a new 2xxx aluminum alloy includes not greater than 0.15 wt. %, in total, of the impurities, and wherein the 2xxx aluminum alloy includes not greater than 0.05 wt. % of each of the impurities. In another embodiment, a new 2xxx aluminum alloy includes not greater than 0.10 wt. %, in total, of the impurities, and wherein the 2xxx aluminum alloy includes not greater than 0.03 wt. % of each of the impurities.

ii. Product Forms

The new alloys may be useful in a variety of product forms, including ingot or billet, wrought product forms (plate, forgings and extrusions), shape castings, additively manufactured products, and powder metallurgy products, for instance.

In one embodiment, a new 2xxx aluminum alloy is in the form of a thick wrought product. Thick wrought aluminum alloy products are those wrought products having a cross-sectional thickness of at least 12.7 mm. The wrought products may be rolled products, forged products or extruded products. In one embodiment, a thick wrought aluminum alloy product has a thickness of at least 25 mm. In another embodiment, a thick wrought aluminum alloy product has a thickness of at least 38 mm. In yet another embodiment, a thick wrought aluminum alloy product has a thickness of at least 50 mm. In another embodiment, a thick wrought aluminum alloy product has a thickness of at least 76 mm. In yet another embodiment, a thick wrought aluminum alloy product has a thickness of at least 102 mm, or higher.

The improved properties described herein may be achieved with thick wrought products having a thickness of up to 305 mm. In one embodiment, a thick wrought aluminum alloy product has a thickness of not greater than 254 mm. In another embodiment, a thick wrought aluminum alloy product has a thickness of not greater than 203 mm. In yet another embodiment, a thick wrought aluminum alloy product has a thickness of not greater than 178 mm. In another embodiment, a thick wrought aluminum alloy product has a thickness of not greater than 152 mm. As used in this paragraph, thickness refers to the minimum thickness of the product, realizing that some portions of the product may realize slightly larger thicknesses than the minimum stated.

iii. Wrought Processing

The new alloy can be prepared into wrought form, and in the appropriate temper, by more or less conventional practices, including direct chill (DC) casting the aluminum alloy into ingot form. After conventional scalping, lathing or peeling (if needed) and homogenization, which homogenization may be completed before or after scalping, these ingots may be further processed by hot working the product. The product may then be optionally cold worked, optionally annealed, solution heat treated, quenched, and final cold worked (e.g., by stretching or compression of from 0.5% to 10%). After the final cold working step, the product may be artificially aged. Thus, in some embodiments, the products may be produced in a T3 or T8 temper. In other embodiments, other T tempers may be used (e.g., any of a T1, T2, T4, T5, T6, T7 or T9 temper). T tempers are defined in ANSI H35.1 (2009).

In some embodiments, forming operations may be completed concomitant to artificial aging, for instance, by forming the alloy into a predetermined shaped product before artificial aging, during artificial aging, after artificial aging, and combinations thereof. In such cases, the accumulated amount of cold work completed after solution heat treatment may be higher, such as from 10-15% cold work, or more.

As noted above, as part of processing to a T temper, the wrought product may be solution heat treated and then optionally cold worked, such as by stretching. In one approach, a wrought product is processed to a T temper and part of that processing includes stretching by from 0.5 to 10% after solution heat treatment. As shown by the below examples, in some instances, appropriate amounts of stretch may facilitate realization of an improved combination of properties, such as an improved combination of two or more of strength, ductility, fracture toughness and stress corrosion cracking resistance properties. In one embodiment, a wrought product is stretched at least 1% after solution heat treatment. In another embodiment, a wrought product is stretched at least 1.5% after solution heat treatment. In yet another embodiment, a wrought product is stretched at least 2% after solution heat treatment. In one embodiment, a wrought product is stretched not greater than 9% after solution heat treatment. In another embodiment, a wrought product is stretched not greater than 8% after solution heat treatment.

iv. Properties

The new 2xxx aluminum alloys generally realize an improved combination of at least two of strength, elongation, fracture toughness, and stress corrosion cracking resistance.

For purposes of this patent application, the "T8 temper" is per ANSI H35.1(2009), and includes all artificial aging conditions, including underaged, peak or near peak aged, and overaged aging conditions.

In one embodiment, a new 2xxx aluminum alloy has a thickness of at least 12.7 mm and realizes a tensile yield strength (LT) of at least 390 MPa in the T8 temper. In another embodiment, a new 2xxx aluminum alloy has a thickness of at least 12.7 mm and realizes a tensile yield strength (LT) of at least 400 MPa in the T8 temper. In yet another embodiment, a new 2xxx aluminum alloy has a thickness of at least 12.7 mm and realizes a tensile yield strength (LT) of at least 410 MPa in the T8 temper. In another embodiment, a new 2xxx aluminum alloy has a thickness of at least 12.7 mm and realizes a tensile yield strength (LT) of at least 420 MPa in the T8 temper. In yet another embodiment, a new 2xxx aluminum alloy has a thickness of at least 12.7 mm and realizes a tensile yield strength (LT) of at least 430 MPa. In another embodiment, a new 2xxx aluminum alloy has a thickness of at least 12.7 mm and realizes a tensile yield strength (LT) of at least 440 MPa. In yet another embodiment, a new 2xxx aluminum alloy has a thickness of at least 12.7 mm and realizes a tensile yield strength (LT) of at least 450 MPa. In another embodiment, a new 2xxx aluminum alloy has a thickness of at least 12.7 mm and realizes a tensile yield strength (LT) of at least 460 MPa, or more, in the T8 temper. The above strength properties may be realized in products having a thickness of at least 25 mm, or at least 38 mm, or at least 50 mm, or at least 76 mm, or at least 108 mm, or higher.

In one embodiment, a new 2xxx aluminum alloy has a thickness of at least 12.7 mm and realizes a plane-strain (KIC) fracture toughness (T-L) of at least 30 MPa-sqrt-m in the T8 temper. In another embodiment, a new 2xxx aluminum alloy has a thickness of at least 12.7 mm and realizes a plane-strain (KIC) fracture toughness (T-L) of at least 31 MPa-sqrt-m in the T8 temper. In yet another embodiment, a new 2xxx aluminum alloy has a thickness of at least 12.7 mm and realizes a plane-strain (KIC) fracture toughness (T-L) of at least 32 MPa-sqrt-m in the T8 temper. In another embodiment, a new 2xxx aluminum alloy has a thickness of at least 12.7 mm and realizes a plane-strain (KIC) fracture toughness (T-L) of at least 33 MPa-sqrt-m in the T8 temper. In yet another embodiment, a new 2xxx aluminum alloy has a thickness of at least 12.7 mm and realizes a plane-strain (KIC) fracture toughness (T-L) of at least 34 MPa-sqrt-m in the T8 temper. In another embodiment, a new 2xxx aluminum alloy has a thickness of at least 12.7 mm and realizes a plane-strain (KIC) fracture toughness (T-L) of at least 35 MPa-sqrt-m in the T8 temper. In yet another embodiment, a new 2xxx aluminum alloy has a thickness of at least 12.7 mm and realizes a plane-strain (KIC) fracture toughness (T-L) of at least 36 MPa-sqrt-m in the T8 temper. In another embodiment, a new 2xxx aluminum alloy has a thickness of at least 12.7 mm and realizes a plane-strain (KIC) fracture toughness (T-L) of at least 37 MPa-sqrt-m in the T8 temper. In yet another embodiment, a new 2xxx aluminum alloy has a thickness of at least 12.7 mm and realizes a plane-strain (KIC) fracture toughness (T-L) of at least 38 MPa-sqrt-m in the T8 temper. In another embodiment, a new 2xxx aluminum alloy has a thickness of at least 12.7 mm and realizes a plane-strain (KIC) fracture toughness (T-L) of at least 39 MPa-sqrt-m in the T8 temper. In yet another embodiment, a new 2xxx aluminum alloy has a thickness of at least 12.7 mm and realizes a plane-strain (KIC) fracture toughness (T-L) of at least 40 MPa-sqrt-m in the T8 temper. In another embodiment, a new 2xxx aluminum alloy has a thickness of at least 12.7 mm and realizes a plane-strain (KIC) fracture toughness (T-L) of at least 41 MPa-sqrt-m in the T8 temper. In yet another embodiment, a new 2xxx aluminum alloy has a thickness of at least 12.7 mm and realizes a plane-strain (KIC) fracture toughness (T-L) of at least 42 MPa-sqrt-m in the T8 temper. In another embodiment, a new 2xxx aluminum alloy has a thickness of at least 12.7 mm and realizes a plane-strain (KIC) fracture toughness (T-L) of at least 43 MPa-sqrt-m in the T8 temper. In yet another embodiment, a new 2xxx aluminum alloy has a thickness of at least 12.7 mm and realizes a plane-strain (KIC) fracture toughness (T-L) of at least 44 MPa-sqrt-m in the T8 temper. In another embodiment, a new 2xxx aluminum alloy has a thickness of at least 12.7 mm and realizes a plane-strain (KIC) fracture toughness (T-L) of at least 45 MPa-sqrt-m in the T8 temper. In yet another embodiment, a new 2xxx aluminum alloy has a thickness of at least 12.7 mm and realizes a plane-strain (KIC) fracture toughness (T-L) of at least 46 MPa-sqrt-m in the T8 temper. In another embodiment, a new 2xxx aluminum alloy has a thickness of at least 12.7 mm and realizes a plane-strain (KIC) fracture toughness (T-L) of at least 47 MPa-sqrt-m in the T8 temper. In yet another embodiment, a new 2xxx aluminum alloy has a thickness of at least 12.7 mm and realizes a plane-strain (KIC) fracture toughness (T-L) of at least 48 MPa-sqrt-m in the T8 temper. In another embodiment, a new 2xxx aluminum alloy has a thickness of at least 12.7 mm and realizes a plane-strain (KIC) fracture toughness (T-L) of at least 49 MPa-sqrt-m in the T8 temper. In yet another embodiment, a new 2xxx aluminum alloy has a thickness of at least 12.7 mm and realizes a plane-strain (KIC) fracture toughness (T-L) of at least 50 MPa-sqrt-m, or more, in the T8 temper. The above fracture toughness properties may be realized in products having a thickness of at least 25 mm, or at least 38 mm, or at least 50 mm, or at least 76 mm, or at least 108 mm, or higher.

In one embodiment, a new 2xxx aluminum alloy has a thickness of at least 12.7 mm and realizes an elongation (LT) of at least 6.0% in the T8 temper. In another embodiment, a new 2xxx aluminum alloy has a thickness of at least 12.7 mm and realizes an elongation (LT) of at least 8.0% in the T8 temper. In yet another embodiment, a new 2xxx aluminum alloy has a thickness of at least 12.7 mm and realizes an elongation (LT) of at least 10.0% in the T8 temper. In another embodiment, a new 2xxx aluminum alloy has a thickness of at least 12.7 mm and realizes an elongation (LT) of at least 12.0%. In yet another embodiment, a new 2xxx aluminum alloy has a thickness of at least 12.7 mm and realizes an elongation (LT) of at least 14.0% in the T8 temper. In another embodiment, a new 2xxx aluminum alloy has a thickness of at least 12.7 mm and realizes an elongation (LT) of at least 16.0%, or more, in the T8 temper. The above elongation properties may be realized in products having a thickness of at least 25 mm, or at least 38 mm, or at least 50 mm, or at least 76 mm, or at least 108 mm, or higher.

In one embodiment, a new 2xxx aluminum alloy has a thickness of at least 12.7 mm and is LT stress corrosion cracking resistant (defined below) in the T8 temper. The LT stress corrosion cracking resistance properties may be realized in products having a thickness of at least 25 mm, or at least 38 mm, or at least 50 mm, or at least 76 mm, or at least 108 mm, or higher.

In one embodiment, a new 2xxx aluminum alloy has a thickness of at least 12.7 mm and is ST stress corrosion cracking resistant (defined below) in the T8 temper. The ST stress corrosion cracking resistance properties may be realized in products having a thickness of at least 25 mm, or at least 38 mm, or at least 50 mm, or at least 76 mm, or at least 108 mm, or higher.

In one embodiment, a new 2xxx aluminum alloy has a thickness of at least 12.7 mm and is both LT stress corrosion cracking resistant and ST stress corrosion cracking resistant in the T8 temper.

While the above properties generally relate to thick plate products, similar properties may also be realized in thick forged product and thick extruded products. Further, many of the above properties may be realized in combination, as shown by the below examples.

v. Definitions

Unless otherwise indicated, the following definitions apply to the present application:

"2xxx aluminum alloys" are aluminum alloys compositions having copper as the major alloying element as per the Aluminum Association definition provided in "International Alloy Designations and Chemical Composition Limits for Wrought Aluminum and Wrought Aluminum Alloys," a.k.a. the "Teal Sheets" (2015). For purposes of this patent application, 2xxx aluminum alloy compositions may be used in non-wrought products, such as in shape castings, ingot/billet, and additively manufactured products, among others. The 2xxx aluminum alloys of the present patent application are generally lithium-free, having less than 0.05 wt. % Li, and generally less than 0.03 wt. % Li, or less than 0.01 wt. % Li.

"Wrought aluminum alloy product" means an aluminum alloy product that is hot worked after casting, and includes rolled products (sheet or plate), forged products, and extruded products.

"Forged aluminum alloy product" means a wrought aluminum alloy product that is either die forged or hand forged.

"Solution heat treating" means exposure of an aluminum alloy to elevated temperature for the purpose of placing solute(s) into solid solution.

"Hot working" means working the aluminum alloy product at elevated temperature, generally at least 250° F.

"Cold working" means working the aluminum alloy product at temperatures that are not considered hot working temperatures, generally below about 250° F. (e.g., at ambient).

"Artificially aging" means exposure of an aluminum alloy to elevated temperature for the purpose of precipitating solute(s). Artificial aging may occur in one or a plurality of steps, which can include varying temperatures and/or exposure times.

Strength and elongation are measured in accordance with ASTM E8 and B557.

Fracture toughness is measured in accordance with ASTM E399.

"LT Stress corrosion cracking resistant" means that at least two-out-of-three specimens of a 2xxx aluminum alloy product do not fail after 10 days of alternate immersion testing at a net stress of 300 MPa in the LT direction and in accordance with ASTM G47 using constant-strain type stressing frame fixtures according to FIG. 4 of ASTM G49, and with three replicate specimens being required for testing. In one embodiment, all three specimens do not fail after 10 days of alternate immersion testing at a net stress of 300 MPa in the LT direction and in accordance with ASTM G47. In another embodiment, all three specimens do not fail after 30 days of alternate immersion testing at a net stress of 300 MPa in the LT direction and in accordance with ASTM G47.

"ST Stress corrosion cracking resistant" means that at least two-out-of-three specimens of a 2xxx aluminum alloy product do not fail after 10 days of alternate immersion testing at a net stress of 250 MPa in the ST direction and in accordance with ASTM G47 and using fixtures according to G49, and with at least 3 specimens being required for testing. In one embodiment, all three specimens do not fail after 10 days of alternate immersion testing at a net stress of 250 MPa in the ST direction and in accordance with ASTM G47. In another embodiment, all three specimens do not fail after 30 days of alternate immersion testing at a net stress of 250 MPa in the ST direction and in accordance with ASTM G47.

As used herein, "additive manufacturing" means "a process of joining materials to make objects from 3D model data, usually layer upon layer, as opposed to subtractive manufacturing methodologies", as defined in ASTM F2792-12a entitled "Standard Terminology for Additively Manufacturing Technologies". Non-limiting examples of additive manufacturing processes useful in producing aluminum alloy products include, for instance, DMLS (direct metal laser sintering), SLM (selective laser melting), SLS (selective laser sintering), and EBM (electron beam melting), among others. Any suitable feedstocks made from the above new 2xxx aluminum alloys may be used, including one or more powders, one or more wires, one or more sheets, and combinations thereof. In some embodiments the additive manufacturing feedstock is comprised of one or more powders comprising the new 2xxx aluminum alloys. Shavings are types of particles. In some embodiments, the additive manufacturing feedstock is comprised of one or more wires comprising the new 2xxx aluminum alloys. A ribbon is a type of wire. In some embodiments, the additive manufacturing feedstock is comprised of one or more sheets comprising the new 2xxx aluminum alloys. Foil is a type of sheet.

These and other aspects, advantages, and novel features of this new technology are set forth in part in the description that follows and will become apparent to those skilled in the art upon examination of the following description and figures, or may be learned by practicing one or more embodiments of the technology provided for by the present disclosure.

The figures constitute a part of this specification and include illustrative embodiments of the present disclosure and illustrate various objects and features thereof. In addition, any measurements, specifications and the like shown in the figures are intended to be illustrative, and not restrictive. Therefore, specific structural and functional details disclosed herein are not to be interpreted as limiting, but merely as a representative basis for teaching one skilled in the art to variously employ the present invention.

Among those benefits and improvements that have been disclosed, other objects and advantages of this invention will become apparent from the following description taken in conjunction with the accompanying figures. Detailed embodiments of the present invention are disclosed herein; however, it is to be understood that the disclosed embodiments are merely illustrative of the invention that may be embodied in various forms. In addition, each of the examples given in connection with the various embodiments of the invention is intended to be illustrative, and not restrictive.

Throughout the specification and claims, the following terms take the meanings explicitly associated herein, unless the context clearly dictates otherwise. The phrases "in one embodiment" and "in some embodiments" as used herein do not necessarily refer to the same embodiment(s), though they may. Furthermore, the phrases "in another embodiment" and "in some other embodiments" as used herein do not necessarily refer to a different embodiment, although they may. Thus, various embodiments of the invention may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references, unless the context clearly dictates otherwise. The meaning of "in" includes "in" and "on", unless the context clearly dictates otherwise.

While a number of embodiments of the present invention have been described, it is understood that these embodiments are illustrative only, and not restrictive, and that many modifications may become apparent to those of ordinary skill in the art. Further still, unless the context clearly requires otherwise, the various steps may be carried out in any desired order, and any applicable steps may be added and/or eliminated.

BRIEF DESCRIPTION OF THE DRAWINGS

FIGS. 1-4 are graphs illustrating the performance of alloys per Examples 2-3.

DETAILED DESCRIPTION

Example 1—Plate Testing

Various 2xxx aluminum alloys were cast as ingots and homogenized. The composition of each ingot is shown in Table 1, below.

TABLE 1

COMPOSITION OF ALLOYS (wt. %)

| Alloy | Ti | Cu | Mg | Mn | Zr | Zn | Ag |
|---|---|---|---|---|---|---|---|
| 1 | 0.01 | 4.95 | 0.50 | 0.34 | 0.11 | 0.02 | 0.34 |
| 2 | 0.05 | 4.97 | 0.48 | 0.34 | 0.11 | 0.02 | 0.34 |
| 3 | 0.06 | 4.96 | 0.50 | 0.35 | 0.07 | 0.02 | 0.34 |
| 4 | 0.10 | 4.83 | 0.49 | 0.35 | 0.07 | 0.02 | 0.33 |
| 5 | 0.05 | 4.95 | 0.29 | 0.34 | 0.07 | 0.02 | 0.34 |
| 6 | 0.10 | 4.84 | 0.30 | 0.34 | 0.06 | 0.02 | 0.34 |
| 7 | 0.10 | 4.82 | 0.37 | 0.35 | 0.07 | 0.49 | 0.34 |
| 8 | 0.11 | 4.97 | 0.40 | 0.34 | 0.07 | 0.02 | 0.49 |

Each ingot contained not greater than 0.04 wt. % Si and not greater than 0.06 wt. % Fe. The balance of each alloy was aluminum, incidental elements and impurities, with no one impurity exceeding 0.05 wt. %, and with the total amount of impurities not exceeding 0.15 wt. %. After homogenization, the alloys were hot rolled to a final gauge of approximately 33 millimeters (mm), solution heat treated, and then quenched in about 195° F. (90.6° C.) water to simulate cooling at T/2 for a 4.5 inch (114.3 mm) thick plate. The alloys were then stretched about 2%, after which the alloys were artificially aged for about 32 hours at about 325° F. (162.8° C.). Approximate final gauges are provided in Table 3b, below.

Various mechanical properties of the T8 aged aluminum alloy plates were measured in accordance with ASTM E8 and B557. Fracture toughness properties of some samples were also measured and in accordance with ASTM E399. The measured strength and fracture toughness properties are shown in Table 2, below.

TABLE 2

Mechanical Properties (Long Transverse (LT) Direction)

| Alloy | TYS (LT) (MPa) | TYS (LT) (ksi) | $K_{IC}$ (T-L) (MPa√m) | $K_{IC}$ (T-L) (ksi√in.) | Elong. (LT) (%) |
|---|---|---|---|---|---|
| 1 | 427 | 61.9 | 31.1 | 28.3 | 11.1 |
| 2 | 427 | 61.9 | 34.9 | 31.8 | 10.4 |
| 3 | 407 | 59.0 | 31.4 | 28.6 | 8.6 |
| 4 | 419 | 60.8 | 31.9 | 29.0 | 9.0 |
| 5 | 382 | 55.4 | 38.8* | 35.3* | 12.9 |
| 6 | 388 | 56.3 | 42.2* | 38.4* | 11.4 |
| 7 | 428 | 62.1 | 36.3 | 33.0 | 10.0 |
| 8 | 415 | 60.2 | 34.3 | 31.2 | 10.0 |

*$K_Q$ value

The SCC (stress corrosion cracking) resistance of the alloys in the ST direction was also tested in accordance with ASTM G47, the results of which are shown in Table 3, below. As shown, the alloys with higher titanium realize improved SCC resistance.

TABLE 3

SCC Resistance Properties (ST direction)

| Alloy | Ti (wt. %) | Net Stress in MPa (ksi) | Samples that passed | Days to failure Sample 1 | Sample 2 | Sample 3 |
|---|---|---|---|---|---|---|
| 1 | 0.01 | 241 (35.0) | 0/3 | 7 | 7 | 7 |
| 1 | 0.01 | 276 (40.0) | 0/3 | 2 | 7 | 3 |
| 2 | 0.05 | 241 (35.0) | 1/3 | 7 | 9 | P |
| 2 | 0.05 | 276 (40.0) | 0/3 | 3 | 8 | 7 |
| 3 | 0.06 | 241 (35.0) | 0/3 | 10 | 7 | 11 |
| 3 | 0.06 | 276 (40.0) | 1/3 | 9 | 10 | P |
| 4 | 0.10 | 241 (35.0) | 2/3 | 23 | P | P |
| 4 | 0.10 | 276 (40.0) | 2/3 | 13 | P | P |
| 5 | 0.05 | 241 (35.0) | 1/3 | 7 | 7 | P |
| 5 | 0.05 | 276 (40.0) | 0/3 | 7 | 7 | 7 |
| 6 | 0.10 | 241 (35.0) | 2/3 | 23 | P | P |
| 6 | 0.10 | 276 (40.0) | 3/3 | P | P | P |
| 7 | 0.10 | 241 (35.0) | 2/3 | 17 | P | P |
| 7 | 0.10 | 276 (40.0) | 3/3 | P | P | P |
| 8 | 0.11 | 241 (35.0) | 2/3 | 14 | P | P |
| 8 | 0.11 | 276 (40.0) | 3/3 | P | P | P |

* P = Passed 30 days

As shown by the data, alloys having more titanium realized an improved combination of properties.

Example 2—Thick Plate Testing

One invention aluminum alloy and two conventional 2039 alloys were cast as ingots. The composition of each ingot is shown in Table 4, below.

TABLE 4

Composition of Alloys (wt. %)*

| Alloy | Ti | Cu | Mg | Mn | Zr | Zn | Ag |
|---|---|---|---|---|---|---|---|
| 9 | 0.11 | 4.97 | 0.40 | 0.36 | 0.07 | 0.50 | 0.35 |
| 2039 (V1) | 0.02 | 5.03 | 0.50 | 0.33 | 0.10 | — | 0.36 |
| 2039 (V2) | 0.02 | 5.01 | 0.49 | 0.33 | 0.10 | — | 0.38 |

*Each ingot contained not greater than 0.04 wt. % Si and not greater than 0.06 wt. % Fe. The balance of each alloy was aluminum, incidental elements and impurities, with no one impurity exceeding 0.05 wt. %, and with the total amount of impurities not exceeding 0.15 wt. %.

After homogenization, the alloys were hot rolled to a final gauge of approximately 127 millimeters (mm). After hot rolling, the alloys were cooled to room temperature, then solution heat treated, and then quenched in room temperature water (approx. 75° F. water). The alloys were then stretched either about 2% or 8%, after which the alloys were artificially aged at about 325° F. (162.8° C.) for various times. Thus, the alloys were in a T8 temper.

Various mechanical properties of the T8 aluminum alloy plates were measured in accordance with ASTM E8 and B557. Fracture toughness properties of some samples were also measured and in accordance with ASTM E399. The measured strength and fracture toughness properties in the long-transverse direction are shown in Tables 5-8, below.

TABLE 5

Properties of Alloy 9 aged at 325° F. with 2% Stretch

| LT (t/4) | | | | T-L (t/4) |
|---|---|---|---|---|
| Aging Time (Hrs) | TYS (ksi) | UTS (ksi) | Elong. (%) | $K_{IC}$ (ksi-sqrt-in) |
| 0 | 38.5 | 61 | 24.8 | 61.8* |
| 8 | 56.5 | 67.7 | 12.8 | 53.1* |
| 12 | 58.9 | 68.3 | 12.2 | 49.2 |
| 16 | 59.9 | 68.7 | 11.2 | 48.8 |
| 24 | 61.5 | 69.3 | 10.2 | 44.2 |
| 32 | 62.0 | 69.4 | 9.0 | 43.1 |
| 48 | 63.0 | 70.6 | 9.0 | 40.6 |
| 72 | 63.0 | 70.5 | 8.8 | 41 |

*Kq value

TABLE 6

Properties of Alloy 9 aged at 325° F. with 8% Stretch

| LT (t/4) | | | | T-L (t/4) |
|---|---|---|---|---|
| Aging Time (Hrs) | TYS (ksi) | UTS (ksi) | Elong. (%) | $K_{IC}$ (ksi-sqrt-in) |
| 0 | 46.3 | 62.9 | 20.2 | 62.6* |
| 8 | 64.7 | 71.8 | 11.5 | 40.5 |
| 12 | 65.8 | 72.3 | 10 | 42 |
| 16 | 65.8 | 72.2 | 9.8 | 39.1 |
| 24 | 65.7 | 72.0 | 10.5 | 38 |
| 32 | 65.5 | 72.0 | 9.5 | 36.7 |
| 48 | 65.1 | 71.9 | 8.5 | 37.1 |
| 72 | 64.2 | 71.2 | 8.5 | 35.8 |

*Kq value

TABLE 7

Properties of the 2039 (V1) Alloy 9 aged at 325° F. with 2% Stretch

| LT (t/4) | | | | T-L (t/4) |
|---|---|---|---|---|
| Aging Time (Hrs) | TYS (ksi) | UTS (ksi) | Elong. (%) | $K_{IC}$ (ksi-sqrt-in) |
| 0 | 46.4 | 61.9 | 18.0 | 43.2 ($K_q$ value) |
| 2 | 43.2 | 64.3 | 22.0 | — |
| 4 | 48.2 | 65.8 | 20.0 | — |
| 8 | 56.3 | 68 | 14.5 | — |
| 16 | 61.6 | 69.8 | 10.0 | 39 |
| 32 | 64.3 | 71.2 | 9.0 | — |
| 48 | 63.5 | 70.3 | 7.0 | — |
| 96 | 64.6 | 71.3 | 8.0 | — |

TABLE 8

Alloy 2039 (V2) aged at 325° F. with 8% Stretch

| LT (t/4) | | | | T-L (t/4) |
|---|---|---|---|---|
| Aging Time (Hrs) | TYS (ksi) | UTS (ksi) | Elong. (%) | $K_{IC}$ (ksi-sqrt-in) |
| 0 | 46.6 | 62.1 | 17 | 48.6 ($K_q$ value) |
| 2 | 54.1 | 67.5 | 17.5 | — |
| 4 | 60.7 | 69.4 | 14 | — |
| 8 | 65.6 | 71.9 | 10 | — |
| 16 | 67.3 | 72.9 | 9 | 32.5 |
| 32 | 67.3 | 72.7 | 7.5 | — |
| 48 | 66.5 | 72.1 | 7.5 | — |
| 96 | 64.9 | 71 | 7.5 | — |

As shown in FIGS. 1-2, the invention alloy achieves an improved strength-fracture toughness trend over the conventional 2039 alloys.

The SCC results of the alloys were also tested in accordance with ASTM G47, the results of which are provided in Tables 9-10, below. A 2xxx alloy passes the SCC test when no failures occur across all three samples over a period of at least 10 days (para 8.2).

TABLE 9

SCC performance of Alloy 9 aged at 325° F.-ST (t/2)*

| | | | Aging | Net | Days to failure | | |
|---|---|---|---|---|---|---|---|
| Alloy | Lot | Stretch (%) | time (h) | stress (ksi) | Specimen 1 | Specimen 2 | Specimen 3 |
| 9 | '533 | 2 | 0 | 36.3 | 12 | 5 | 3 |
| | | | 8 | 36.3 | 3 | 12 | 3 |
| | | | 12 | 36.3 | 3 | 3 | 5 |
| | | | 16 | 36.3 | 10 | 5 | 3 |
| | | | 24 | 36.3 | 10 | 10 | 12 |
| | | | 32 | 36.3 | 10 | 20 | 12 |
| | | | 48 | 36.3 | 43 | T50 | 14 |
| | | | 72 | 36.3 | T50 | T50 | T50 |
| 9 | '531 | 8 | 0 | 36.3 | 2 | 14 | 12 |
| | | | 8 | 36.3 | 10 | 12 | 12 |
| | | | 12 | 36.3 | 52 | 54 | 80 |
| | | | 16 | 36.3 | T91 | T91 | 91 |
| | | | 24 | 36.3 | 31 | 91 | T91 |
| | | | 32 | 36.3 | 91 | 91 | 91 |
| | | | 48 | 36.3 | 12 | 21 | T50 |
| | | | 72 | 36.3 | T50 | 36 | 12 |

*T50 = still in test after 50 days; T91 = still in test after 91 days

TABLE 10

SCC performance of Alloy 9 aged at 325° F.-ST (t/2)

| | | Aging | Net | Days to failure | | |
|---|---|---|---|---|---|---|
| Alloy | Stretch (%) | time (h) | stress (ksi) | Specimen 1 | Specimen 2 | Specimen 3 |
| 2039 (V1) | 2 | 0 | 35 | 1 | 1 | 5 |
| | | 2 | 35 | 3 | 3 | 4 |
| | | 4 | 35 | 1 | 1 | 3 |
| | | 8 | 35 | 1 | 3 | 4 |
| | | 16 | 35 | 3 | 4 | 5 |
| | | 32 | 35 | 3 | 4 | 5 |
| | | 48 | 35 | 3 | 3 | 6 |
| | | 96 | 35 | 7 | 7 | 7 |
| 2039 (V2) | 8 | 0 | 35 | 1 | 1 | 1 |
| | | 2 | 35 | 1 | 1 | 5 |
| | | 4 | 35 | 3 | 4 | 4 |
| | | 8 | 35 | 5 | 7 | 10 |
| | | 16 | 35 | 3 | 4 | 8 |
| | | 32 | 35 | 3 | 4 | 4 |

TABLE 10-continued

| SCC performance of Alloy 9 aged at 325° F.-ST (t/2) | | | | | | |
|---|---|---|---|---|---|---|
| | | Aging | Net | Days to failure | | |
| Alloy | Stretch (%) | time (h) | stress (ksi) | Specimen 1 | Specimen 2 | Specimen 3 |
| | | 48 | 35 | 4 | 3 | 4 |
| | | 96 | 35 | 3 | 6 | 7 |
| | | 96 | 35 | 3 | 6 | 7 |

As shown, invention Alloy 9 passes the SCC test at multiple different aging times at both stretch levels. Conversely, none of the 2039 alloys are able to pass the SCC testing. Thus, not only does invention alloy 9 achieve an improved combination of strength and fracture toughness over the 2039 alloy, it also has much better corrosion resistance than the 2039 alloy.

Example 3—Aging of Alloy 9 at 350° F.

Samples of Alloy 9 from Example 2 were processed as per Example 2 with the exception that the alloys were aged at 350° F. instead of 325° F. Alloy properties were again measured, the results of which are shown in Tables 11-13, below.

TABLE 11

| Properties of Alloy 9 aged at 350° F. with 2% Stretch | | | | |
|---|---|---|---|---|
| LT (t/4) | | | | T-L (t/4) |
| Aging Time (Hrs) | TYS (ksi) | UTS (ksi) | 5D Elong. (%) | $K_{IC}$ (ksi-sqrt-in) |
| 16 | 62 | 69.6 | 7.4 | 41.9 |
| 24 | 60.8 | 69.1 | 7.2 | 42.9 |
| 36 | 59.8 | 68.3 | 7.1 | 41.7 |

TABLE 12

| Properties of Alloy 9 aged at 350° F. with 8% Stretch | | | | |
|---|---|---|---|---|
| LT (t/4) | | | | T-L (t/4) |
| Aging Time (Hrs) | TYS (ksi) | UTS (ksi) | 5D Elong. (%) | $K_{IC}$ (ksi-sqrt-in) |
| 16 | 63.5 | 70.7 | 7.6 | 36.8 |
| 24 | 62.3 | 69.8 | 7.0 | 37.4 |
| 36 | 60.9 | 69.2 | 6.6 | 38 |

TABLE 13

| SCC performance of Alloy 9 aged at 350° F.-ST (t/2)* | | | | | | | |
|---|---|---|---|---|---|---|---|
| | | | Aging | Net | Days to failure | | |
| Alloy | Lot | Stretch (%) | time (h) | stress (ksi) | Specimen 1 | Specimen 2 | Specimen 3 |
| 9 | '533 | 2 | 16 | 36.3 | T35 | T35 | T35 |
| | | | 24 | 36.3 | T35 | T35 | T35 |
| | | | 36 | 36.3 | T35 | T35 | T35 |
| 9 | '531 | 8 | 16 | 36.3 | 4 | 14 | T35 |
| | | | 24 | 36.3 | T35 | T35 | T35 |
| | | | 36 | 36.3 | T35 | T35 | T35 |

*T35 = still in test after 35 days

As shown in FIGS. 3-4, while the strength-toughness trends for the 350° F. aged alloys is slightly decreased relative to the 325° F. alloy, the SCC performance is improved, especially with the 2% stretched materials.

While various embodiments of the present disclosure have been described in detail, it is apparent that modifications and adaptations of those embodiments will occur to those skilled in the art. However, it is to be expressly understood that such modifications and adaptations are within the spirit and scope of the present disclosure.

What is claimed is:

1. A 2xxx aluminum alloy comprising:
from 0.10 to 0.13 wt. % Ti;
from 4.8 to 5.0 wt. % Cu;
from 0.49 to 1.0 wt. % Zn;
from 0.30 to 0.40 wt. % Mn;
from 0.30 to 0.50 wt. % Mg;
from 0.30 to 0.40 wt. % Ag;
from 0.07 to 0.12 wt. % Zr;
up to 0.15 wt. % Fe;
up to 0.10 wt. % Si;
up to 0.05 wt. % Cr;
up to 0.05 wt. % V; and
up to 0.05 wt. % Li;
the balance being aluminum, incidental elements and impurities,
wherein the 2xxx aluminum alloy includes not greater than 0.15 wt. %, in total, of the impurities,
wherein the 2xxx aluminum alloy includes not greater than 0.05 wt. % of each of the impurities, and
wherein the wrought product realizes a tensile yield strength (LT) of at least 390 MPa.

2. The 2xxx aluminum alloy of claim 1, wherein the 2xxx aluminum alloy is in the form of a wrought product, and wherein the wrought product has a cross-sectional thickness of from 12.7 mm to 305 mm.

3. The 2xxx aluminum alloy of claim 2, wherein the wrought product is in a T8 temper.

4. The 2xxx aluminum alloy of claim 1, wherein the wrought product realizes a plane-strain ($K_{IC}$) fracture toughness (T-L) of at least 30 Mpa-sqrt-m.

5. The 2xxx aluminum alloy of claim 4, wherein the wrought product realizes an elongation (LT) of at least 6.0%.

6. The 2xxx aluminum alloy of claim 5, wherein the wrought product is (a) LT stress corrosion cracking resistant, (b) ST stress corrosion cracking resistant, or (c) both LT stress corrosion cracking resistant and ST stress corrosion cracking resistant.

7. The 2xxx aluminum alloy of claim 1, wherein the 2xxx aluminum alloy includes not greater than 0.90 wt. % Zn.

8. The 2xxx aluminum alloy of claim 1, wherein the 2xxx aluminum alloy includes not greater than 0.80 wt. % Zn.

9. The 2xxx aluminum alloy of claim 1, wherein the 2xxx aluminum alloy includes not greater than 0.70 wt. % Zn.

10. The 2xxx aluminum alloy of claim 1, wherein the 2xxx aluminum alloy includes not greater than 0.60 wt. % Zn.

11. The 2xxx aluminum alloy of claim 1, wherein the 2xxx aluminum alloy includes not greater than 0.10 wt. % Fe.

12. The 2xxx aluminum alloy of claim 1, wherein the 2xxx aluminum alloy includes not greater than 0.07 wt. % Si.

13. The 2xxx aluminum alloy of claim 1, wherein the 2xxx aluminum alloy includes not greater than 0.03 wt. % Cr.

14. The 2xxx aluminum alloy of claim 1, wherein the 2xxx aluminum alloy includes not greater than 0.03 wt. % V.

15. The 2xxx aluminum alloy of claim 1, wherein the 2xxx aluminum alloy is in the form of an additively manufactured product, an additive manufacturing feedstock, a shape cast product, or an ingot.

16. A wrought product made from the 2xxx aluminum alloy of claim 1.

17. The wrought product of claim 16, wherein the wrought product is one of a plate product, an extruded product, or a forged product.

18. The wrought product of claim 16, wherein the wrought product is in a T3 or a T8 temper.

19. The wrought product of claim 16, wherein the wrought product has a thickness of at least 108 mm.

* * * * *